United States Patent [19]

Gudas

[11] 4,268,980

[45] May 26, 1981

[54] DETORQUING HEEL CONTROL DEVICE FOR FOOTWEAR

[75] Inventor: Charles J. Gudas, Lockport, Ill.

[73] Assignee: Scholl, Inc., Chicago, Ill.

[21] Appl. No.: 958,208

[22] Filed: Nov. 6, 1978

[51] Int. Cl.[3] ..... A43B 13/38; A43B 19/00; A43B 21/32

[52] U.S. Cl. ..... 36/43; 36/37; 36/71

[58] Field of Search ..... 36/43, 44, 71, 37; 128/583, 584, 585

[56] References Cited

U.S. PATENT DOCUMENTS

| | | | |
|---|---|---|---|
| 4,120,102 | 10/1978 | Kenigson | 36/71 |
| 4,168,585 | 9/1979 | Gleichner | 36/37 |

FOREIGN PATENT DOCUMENTS

| | | | |
|---|---|---|---|
| 382819 | 10/1923 | Fed. Rep. of Germany | 36/37 |
| 1511344 | 12/1967 | France | 36/43 |
| 327015 | 3/1930 | United Kingdom | 36/37 |

*Primary Examiner*—James Kee Chi

*Attorney, Agent, or Firm*—Hill, Van Santen, Steadman, Chiara & Simpson

[57] ABSTRACT

A shock absorbing, relatively rigid but resilient slab for insertion in footwear as an insole or for being built integrally into the sole of footwear, extends across the shoe width and lengthwise from the outer rear border of the heel to the metatarsal heads of the foot of the wearer, has a smooth top surface with a heel concavity and a varus heel ridge extending transversely from the lateral to the medial side and inclined upward to a high level at the medial side and then continuing medially to the rear end of the heel cup and with a bottom having a solid lateral edge mitigating shock at the initial heel contact and from which radiate circumferentially in a clockwise direction around the heel for an arc of about 30° and then along the medial edge, a plurality of longitudinally spaced ribs increasing in width along their length toward the medial side providing rotors which develop an external rotational force on the heel and tibiofibular leg unit of the wearer to detorque the internal rotation of the leg unit and pronation of the sub-talar joints and cause supination of the foot.

19 Claims, 21 Drawing Figures

DETORQUING HEEL CONTROL DEVICE FOR FOOTWEAR

FIELD OF THE INVENTION

This invention relates to the biomechanical art of controlling torque on the heel and tibiofibular leg unit of people during walking, jogging, or running and specifically deals with a device insertable as an insole in footwear or built integrally into footwear which will mitigate impact at heat contact to the flat foot stage up to about the first 25% of the gait cycle and will create an external rotational force on the heel and tibiofibular leg unit which causes supination.

BACKGROUND OF THE INVENTION

In normal straight ahead walking and running, the average person contacts the heel first in the stance phase of gait. At the time of ground contact, the heel hits on the outside or lateral side, gradually shifts to the inner portion of the heel and then to the outer side of the foot over the metatarsals and then finally through the great toe for the final phase of propulsion. The period of time from the initial heel contact to the stage when the foot is flat is about the first 20 to 25% of the gait. At the time of heel contact when the body weight is borne on the heel, the leg is internally rotating, the ankle joint is dorsiflexing, and the sub-talar joints are pronating to accommodate any uneven surface and to cushion the shock of the body weight as it passes from the center of gravity through the ankle, the sub-talar joints and the foot.

The estimated body weight during walking is about 1½ to 2 times the normal body weight at the heel strike and 2 to 4 times the normal body weight during running.

It is the purpose of this invention to provide a device which will so modify the biomechanics of walking, jogging and running to mitigate impact at heel contact to the foot flat state and to develop an external rotational force on the heel and tibiofibular unit of the leg to cause supination. The device of this invention decreases the end range of pronation of the sub-talar joints preventing overuse syndrome characterized by Achilles Tendonitis, posterior tibial tendonitis, shin splints, runner's knee, and various other maladies affecting the foot, ankle and leg.

SUMMARY OF THIS INVENTION

According to this invention a shoe insert slab is molded from a relatively rigid non-slipping type of plastics material such as polyurethane, nylon, thermoplastic rubber, and other suitable elastomers preferably having a Shore hardness of from 30 to 80 with a Shore hardness range of 45 to 65 being desirable. Such plastics materials will not collapse under the weight of the wearer but will provide a desired degree of shock absorbing resiliency. The slabs are shaped to fit footwear as an insole extending from the rear of the heel to the metatarsal heads of the foot and tapering from an arch ridge forwardly to a thin convex forward end. A heel cavity is provided rearwardly from the arch ridge and the ridge is inclined upwardly from the lateral to the medial side with the high level continuing along the medial edge to the rear end of the heel cup. This provides a 3.2 varus heel with about a 30° medial incline from the lateral to the medial sides of the insole.

The top surface of the device is smooth and the foot or sock of a wearer will slide freely thereover without shifting the device in the shoe.

The bottom of the device has a flat solid portion extending along the lateral side from which radiate in a clockwise direction a plurality of ribs separated by grooves or troughs and increasing in width to wide ends at the medial edge of the device. The taper of the ribs is such that the grooves therebetween are of uniform width along their lengths.

The solid lateral portion of the bottom has a relatively thick rib portion extending from the rear lateral side of the heel to a wider solid portion extending in a medial direction from the lateral edge to a circular arc edge which has its widest portion or maximum width at about the front end of the heel cup and then curves back toward the lateral edge to a diverging straight edge sloping forwardly and medially to a solid portion across the entire width at the front end of the device. The ribs radiate like spokes from the arc edge in a clockwise direction and thus extend rearwardly behind the widest portion of the arcuate edge of the solid portion which would appear in top plan to extend clockwise from the 6:00 o'clock to the 9:00 o'clock position and then radiate forwardly from the 9:00 o'clock to about the 11:00 o'clock position. The arrangement of these ribs is to provide rotors which will deflect under load creating an external rotation force tending to raise the arch of the foot and cause supination. These rotors when loaded by the foot deflect into the grooves therebetween producing a clockwise movement to supinate the foot during the first 25% of the gait cycle and decreasing the end rate of pronation which will maintain the tibiofibular unit in more of a straight ahead position to increase the forward propulsion effect of the gait. A falling domino reaction develops as the ribs are deflected successively upon application of foot load to cause the outward rotation which will detorque the heel, raise the arch, and minimize inward pronation of the tibiofibular leg unit.

It is proposed that the devices of this invention be furnished in sizes for fitting several shoe sizes. Thus, for example, the devices of this invention for insertion in men's shoes could be furnished with an average "D" width in sizes accommodating shoe sizes 6 and 7; 8 and 9; 10 and 11; and 12 and 13 while the devices for ladies' shoes could be furnished with an average "B" width in sizes accommodating shoe sizes 5 and 6; 7 and 8; and 9 and 10.

It is then an object of this invention to provide a device for footwear which will detorque the internal rotation of the tibiofibular leg unit in walking, jogging or running.

Another object of this invention is to provide an insole for insertion in footwear or for integrally building into footwear which provides torque control radiating around an arc for mitigating impact at heel contact to the foot flat stage while creating an external rotational force causing supination of the heel and tibiofibular unit during walking, running or jogging.

A specific object of this invention is to provide a molded plastics insert for footwear having radiating ribs which will detorque pronation of the heel and tibiofibular unit of a wearer during walking, jogging or running gaits.

A specific object of the invention is to provide a relatively rigid but resilient bendable molded plastics material insole of average shoe width and a length extending from the back of the shoe heel to a forward thin edge at about the position in the shoe where the metatarsal heads of the foot will rest, which has a heel concavity, an inclined varus heel ridge in front of the cavity diverging from the lateral to the medial sides thereof, tapers from the ridge to a thin convex front end edge, has a bottom with solid narrow areas at the lateral side of the heel widening to the full width of the front end and has longitudinally spaced bottom ribs radiating clockwise from the narrow solid portion to the medial side which are effective to deflect under load creating a rotational force to swing the footwear outwardly during the first 25% of the gait of the wearer thereby decreasing the end range of pronation of the heel and tibiofibular unit during the gait of the wearer.

Another specific object of the invention is to provide an insole for footwear which will cushion heel impact and detorque pronation during the first 25% of the gait of the wearer.

Other and further objects of this invention will become apparent to those skilled in this art from the following detailed descriptions of the drawings which, by way of a preferred example only illustrate one embodiment of the invention.

ON THE DRAWINGS

FIGS. 10 to 21 are diagrammatic views demonstrating the operation of the device of FIGS. 1 to 9 during successive phases of the gait of a user in which:

FIG. 10 is a diagrammatic phantom top plan view of the device showing its initial condition upon application of the heel impact load at the start of the gait.

FIG. 11 is a longitudinal view along the line XI—XI of FIG. 10.

FIG. 12 is a transverse view along the line XII—XII of FIG. 10.

FIG. 13 is a view similar to FIG. 10 but showing the condition of the device at a flat heel position prior to the flat foot stage of the gait.

FIG. 14 is a longitudinal view along the line XIV—XIV of FIG. 13.

FIG. 15 is a transverse view along the line XV—XV of FIG. 13.

FIG. 16 is a view similar to FIG. 10 but showing the condition of the device at the flat foot position of the gait.

FIG. 17 is a longitudinal view along the line XVII—XVII of FIG. 16.

FIG. 18 is a transverse view along the line XVIII—XVIII of FIG. 16.

FIG. 19 is a view similar to FIG. 10 but showing the condition of the device during the final phase of propulsion during the end of the gait.

FIG. 20 is a longitudinal view along the line XX—XX of FIG. 19, and

FIG. 21 is a transverse view along the line XXI—XXI of FIG. 19.

AS SHOWN ON THE DRAWINGS

Figure 3:
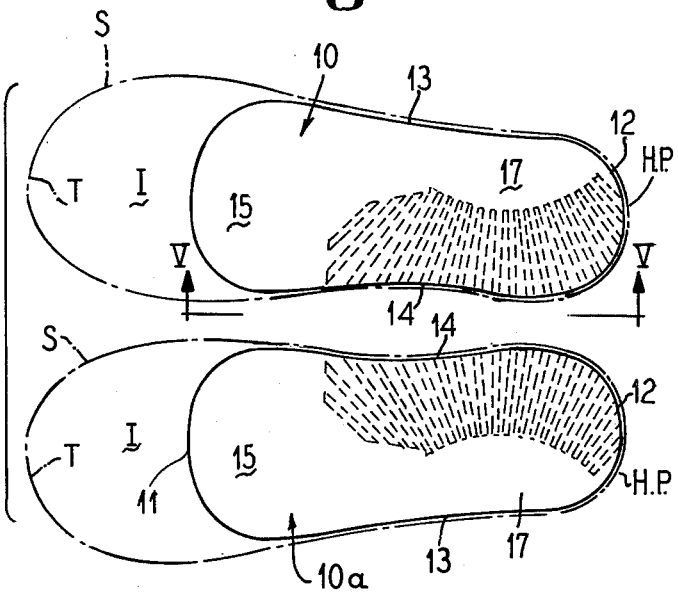
FIG. 3 are top plan views of right and left foot devices of this invention mounted in footwear shown in dotted lines.

The device 10 of this invention is illustrated throughout the drawings as a slab-like insole for the right shoe of a user but as shown in FIG. 3, the invention includes an insole 10*a* for the left shoe which is the mirror image of the device 10. For convenience, the right shoe insole will be described specifically hereinafter but it should be understood of course that pairs of the devices will be furnished to the user which are mirror images of each other and will be marked for insertion in right and left shoes. It will also be understood that the devices can be built integrally into the shoe soles of footwear by the shoe manufacturer.

Figure 2:
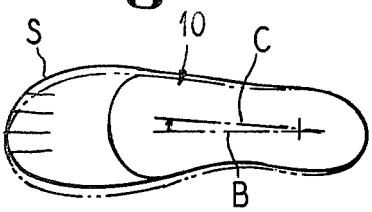
FIG. 2 is a diagrammatic phantom plan view illustrating the operation of the device of this invention.
Figure 1:
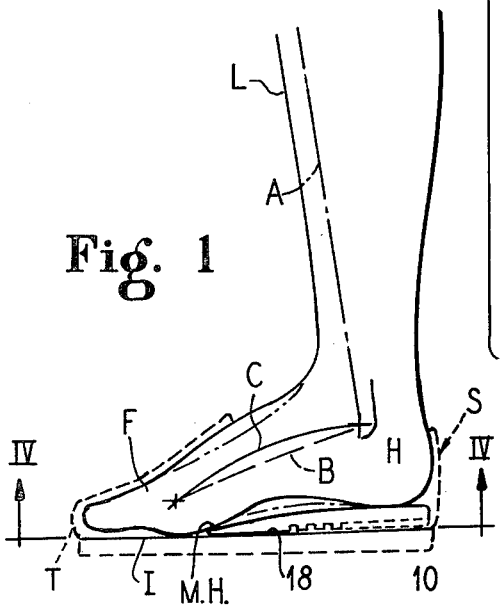
FIG. 1 is a side elevational diagrammatic view illustrating the operation of the device of this invention.

As shown in FIG. 1, the device 10 is mounted in a shoe S on the inner sole I of the shoe and extends from the rear end of the heel of the shoe to a thin tapered front edge spaced rearwardly from the toe T of the shoe. The tibiofibular leg unit L of a wearer has the foot F inserted in the shoe S with the heel H of the foot resting on the rear end of the device 10 and the metatarsal heads M.H. of the foot resting on the front thin tapered edge of the device 10. The line A represents the forwardly inclined axis of the leg unit L during the forward gait as in walking or running following initial heel impact while the line B represents the flat inclined axis of the subtalar foot bones as would normally occur if the foot were resting on the normal flat inner sole I of the shoe S. However the device 10 of this invention lifts or inclines this axis B to the curved position C raising the arch of the foot as the gait progresses to a full flat foot condition. During this forward gait movement the leg unit L tends to rotate inwardly but, as illustrated in FIG. 2, the device 10 of this invention shifts the shoe S outwardly as load is applied to the device changing the longitudinal foot axis from B to C which is laterally outward from the plane of axis B.

Thus the device 10 of this invention receives the heel impact on its outside or lateral side and at the time of ground contact the load is gradually shifted to the inner portion of the heel and then to the outer side of the foot over the metatarsal heads and finally through the great toe for the final phase of propulsion as in walking or running. The first 20 to 25% of the gait involves foot movement from initial heel contact to full flat position and at the time of initial heel contact the leg unit L normally rotates inwardly, the ankle joint dorsiflexes and the sub-talar joints pronate to accommodate the uneven surface and to cushion the shock of the body weight as it passes from the center of gravity through the ankle, the sub-talar joints and the foot.

The devices 10 of this invention are positioned in a pair of right and left shoes S as shown at 10 and 10*a* in FIG. 3 to extend from a rounded or convex feather front edge 11 rearwardly from the toes T of the shoes to rounded rear ends 12 fitting the rear end of the heel portion H.P. of the shoes. The lateral or outer sides 13 of the device 10 snugly follow the outer side edges of the shoe insole I while the inner or medial edges 14 of the device snugly follow the inner or medial sides of the shoe inner sole I.

Figure 5:
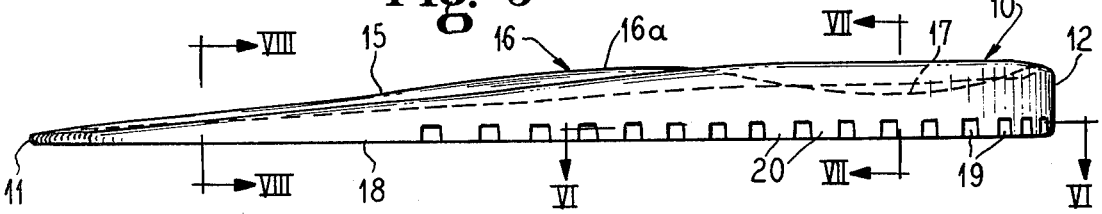
FIG. 5 is a side elevational view of the device of this invention taken along the line V—V of FIG. 3 and shown on a larger scale.
Figure 8:
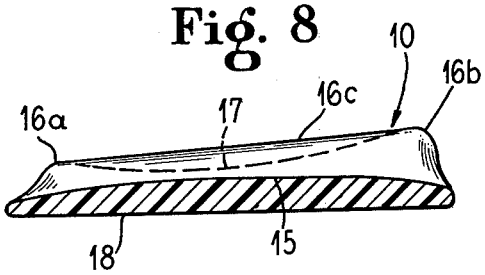
FIG. 8 is a transverse cross sectional view taken along the line VIII—VIII of FIG. 5.

As shown in FIGS. 3 and 5 the device 10 has a smooth top surface 15 increasing in thickness from the thin front edge 11 to a transverse heel arch 16 and as shown in FIG. 8 this portion of the top surface can be slightly convex across its width to provide a comfortable crown receiving the metatarsal portion of the foot. A heel depression or concavity 17 is formed in the top surface behind the ridge 16 for comfortably nestling the heel H of the foot F.

The ridge 16 is inclined upwardly from a low point 16*a* at the lateral or outer edge of the device to a high point 16*b* at the inner or medial edge of the device immediately forwardly of the heel concavity 17 and the high ridge 16*b* extends at 16*c* medialward around the concavity 17 to the rear of the concavity.

It is desired that, from front to rear, the devices increase in thickness from the thin toe end 11 to the ridge 16 and that this increase be such as to provide a 3.2 varus heel from lateral to medial with the high point being medial and extending medialward to the end of the heel cup.

Figure 4:
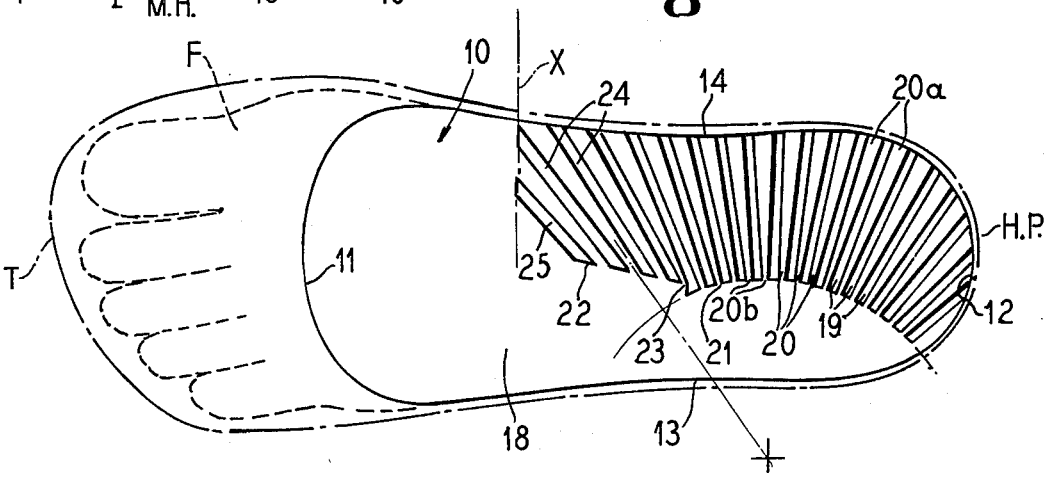
FIG. 4 is a bottom plan view taken generally along the line IV—IV of FIG. 1 showing a device of this invention for a right foot.

The bottom 18 of the device is flat and is solid along the lateral side from the front 11 to the heel 12 but the medial side of the bottom from the heel for about two-thirds of the length of the device is provided with spaced parallel slots 19 which define therebetween ribs 20 extending flush with the bottom and radiating in a clockwise direction around the back of the heel to an extremity indicated at the line X in FIG. 4 which is about two-thirds the length of the device so that one-third of the device forwardly of the line X is not grooved. These ribs 20 increase in width as they extend outwardly from the solid bottom portion 18 so that their outer ends 20*a* are wider than their inner ends 20*b* with the grooves 19 being of uniform width throughout their length.

As shown in FIG. 4 the ribs radiate clockwise from a circular baseline 21 struck from a center behind the ridge 16 and laterally spaced from the lateral edge of the device so that the ribs will radiate like spokes around the medial heel portion and will then radiate from a flat diagonal line 22 connected by a shoulder 23 to the forward end of the arc 21. The ribs 20 radiating from the arc 21 vary in length to follow the medial contour of the insole. Forward ribs 24 radiate from the diagonal line 22 to the medial edge of the insole while a front rib 25 has a blind outer end at the line X representing the forward ends of the ribs.

The rib arrangement is such that initial heel impact will occur on the solid bottom surface 18 at the lateral side of the end of the heel and then as the foot flattens the weight will be borne by the radiating ribs on the medial side at the heel end. As the foot progresses to a flat position during the gait, the weight will be borne progressively from the rearward to the forward ribs. This progressive loading of the ribs tends to flatten and widen them into the grooves 19.

Figure 6:
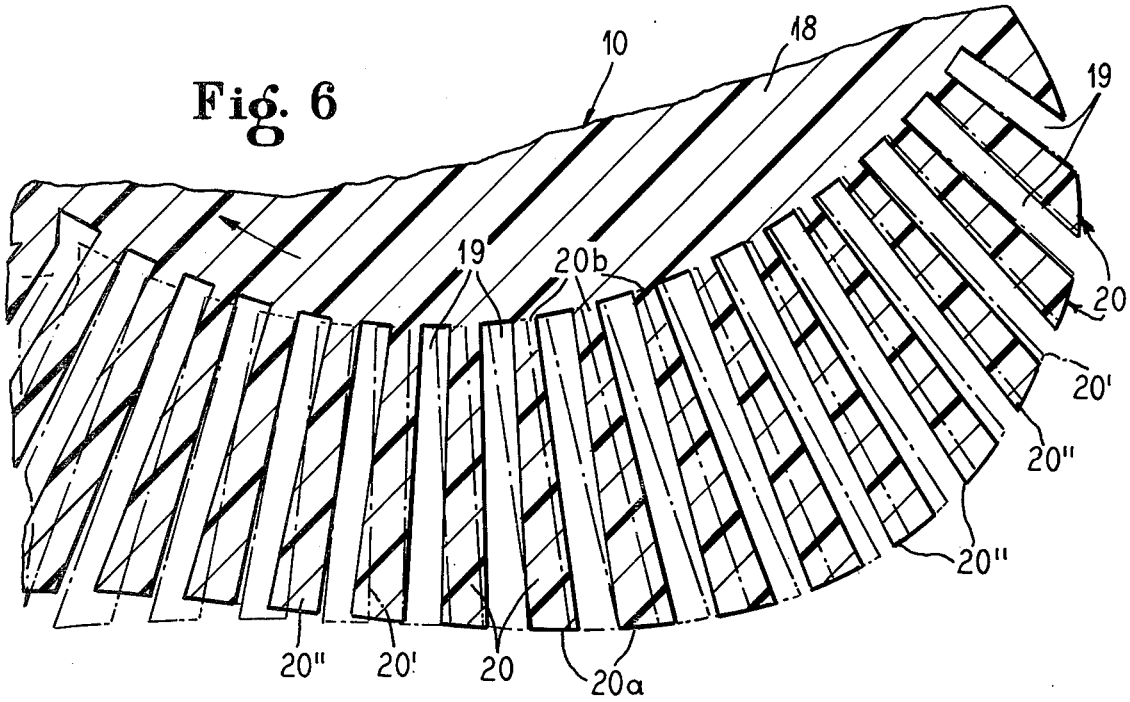
FIG. 6 is an enlarged fragmentary longitudinal sectional view taken along the line VI—VI of FIG. 5 and illustrating deflection of the ribs under load.
Figure 7:
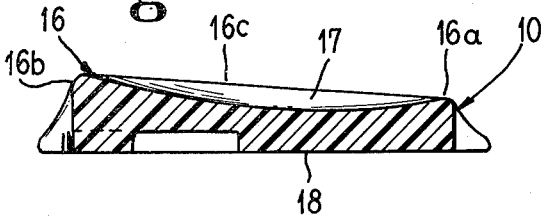
FIG. 7 is a transverse cross sectional view taken along the line VII—VII of FIG. 5.

FIG. 6 attempts to illustrate the rotating movement of the device 10 in the direction of the arrow as the ribs come under load to be deflected and rotated forwardly to effect the lateral rotation of the insole. Thus as shown in FIG. 6 the dotted line positions 20' show the initial unloaded position of each rib 20. As load is applied to these ribs 20 they will flatten and widen into the grooves 19 more at the outer peripheries than at their inner ends causing each successive rib to rotate clockwise to a loaded and flattened advanced position 20'' shown in solid lines. This successive loading of the ribs from the initial heel loading forwardly to a flat foot condition causes them to act as rotors swinging the device in a clockwise position for the right foot as shown by the arrow in FIG. 6 and thus moving the axis from B to C as shown in FIG. 2 of the drawings. The shifting is progressive since each successively loaded rib will have a forward rotating affect on the next adjacent rib without, however, actually closing the grooves 19 between the ribs. Since the ribs decrease in width inwardly to the arcuate baseline 21 with the solid bottom 18, the amount of flattening or deflection will progressively diminish inwardly along the length of the ribs. When the foot load is released from the rib areas of the device, the resilient nature of the plastics material constituting the device will cause the ribs to immediately regain their initial free state condition.

Figure 9:
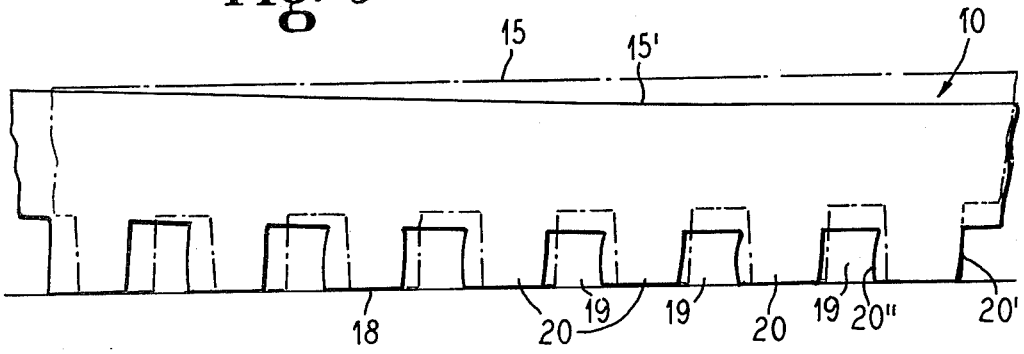
FIG. 9 is an enlarged diagrammatic fragmentary side elevational view of the device illustrating the rotation forces obtained by loading of the ribs.

As also illustrated in FIG. 9 when weight W is applied to the top surface 15 of the device 10 depressing the height thereof to the level 15', the ribs 20 will decrease in height from their unloaded position 20' and will increase in width to their less high and widened condition 20'' causing the progressive clockwise rotation to turn the device in the clockwise direction as illustrated in FIG. 6.

It should thus be understood that the spoke-like ribs radiating from a center beyond the lateral side of the device 10 as illustrated at Y in FIG. 4 will progressively flatten and shift in a clockwise direction to rotate the device and the shoe of the wearer for detorquing the normal inward deflection of the tibiofibular leg unit in walking, running or jogging.

It will of course be understood that the clockwise rotation of the right shoe with a right insole device of this invention will be countered by a counterclockwise rotation of the left shoe with a left device of this invention because the devices are provided in pairs for right and left shoes and are mirror images of each other.

The provision of the diagonal terminous line 22 projecting forwardly from the shoulder 23 at the end of the arc 22 on the bottom 18 of the insole provides shortened forward ribs 24 and 25 and produces a wider flat bottom portion 18. Longer ribs are not needed at this area since by the time the weight of the foot is on these forward ribs, pronation is just about finished and extension of the ribs could provide an excessive detorquing.

OPERATION DURING SUCCESSIVE GAIT STAGES

FIGS. 10 through 21 attempt to illustrate the successive conditions of the device 10 as the gait of a user progresses from initial heel contact to final toe propulsion. It should be understood that the plan views of these Figures are illustrated in phantom looking downward from the top but showing the condition of the bottom of the devices.

Figure 10:
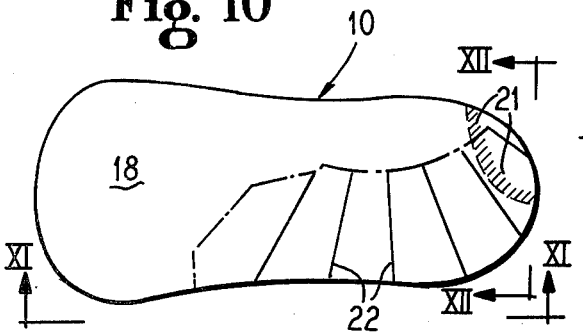
Figure 11:
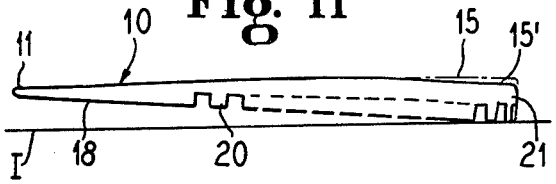
Figure 12:
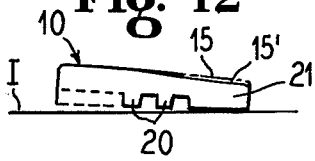

Thus as shown in FIGS. 10 to 12 the device 10 is in its condition of initial heel impact at the start of the gait. At this stage the initial load is at zone 21 at the lateral rear end with the device tilted laterally and transversely upwardly from the impact zone 21. Since the device is somewhat resilient the initial impact load will be cushioned decreasing the free stage top level 15 of the heel cup to the depressed level 15' as described above. At this initial stage of the gait the ribs 20 have not yet been loaded and radiate as diagrammatically illustrated at 22 in their free state condition.

Figure 13:
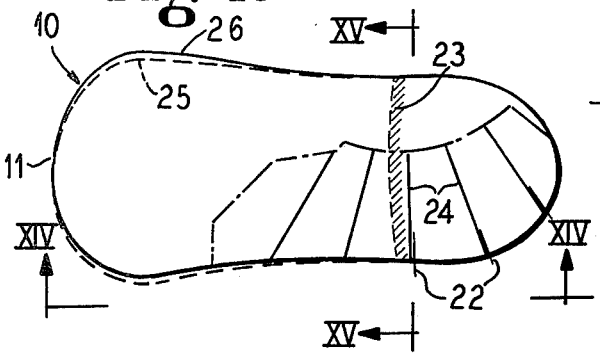
Figure 14:
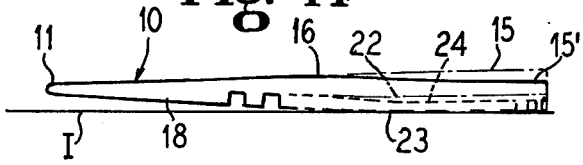
Figure 15:
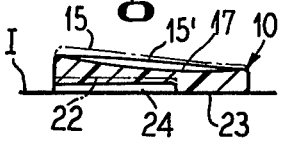

During the next phase of the gait, as illustrated in FIGS. 13 to 15 the heel load advances to a forward zone illustrated at 23 including the ribs to the rear of this zone since the heel area is now in contact with the ground across its full width and for about the full length of the heel cup 17. The rear ribs are thus flattened and rotate clockwise from their initial free state condition at 22 to an advanced position illustrated at 24. This rotation of the ribs swings the device 10 from the dotted line position 25 to the lateral displaced position 26 and this swinging is unimpeded because the front portion of the device is not yet loaded nor has the front underlying portion of the shoe yet engaged the ground.

It will thus be understood that as the gait advances from the initial heel impact zone 21 to the full heel impact zone 23, the ribs are effective to swing the device clockwise or laterally outward.

This swinging motion is accompanied by a lifting of the arch due to the inclined varus angle of the heel ridge 16.

Figure 16:
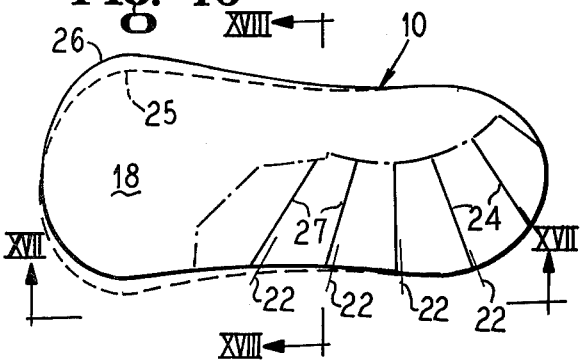
Figure 17:
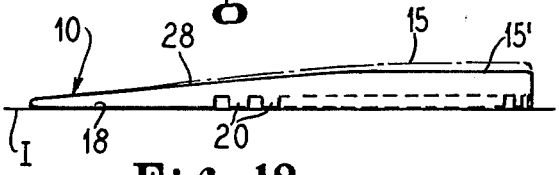
Figure 18:
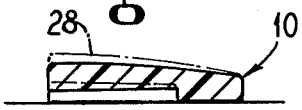

During the next phase of the gait as illustrated in FIGS. 16 to 18 the device is under a full flat foot load and the bottom 18 flattens into full engagement with the inner sole I of the shoe. In this condition all of the ribs 20 are loaded with the forwardly inclined ribs being advanced to position 27 which are further displaced from their free state positions 22 than the displacement of the rearwardly directed ribs. These forward ribs then add to the lateral displacement providing an increased increment of displacement between 25 and 26. In the flat foot condition the arch is raised due to the varus inclination of the device extending forwardly of the ridge 16 and the cushioning effect extends forwardly of the rib area and the loaded zone extends as illustrated at 28 along the full length of the device.

Figure 19:
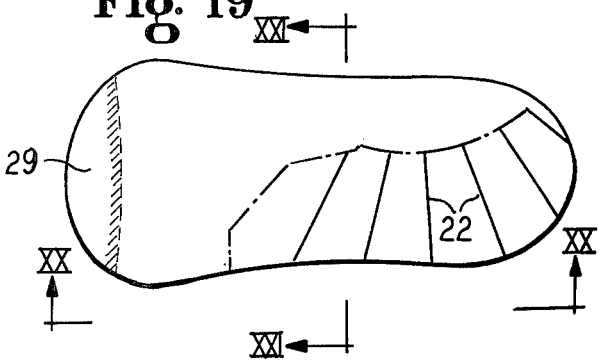
Figure 20:
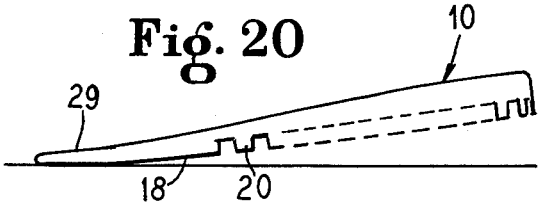
Figure 21:
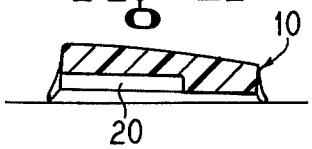

In the toe propulsion or final stage of the gait as illustrated in FIGS. 19 through 21 the load is transferred to the toe area at 29 and the ribs are unloaded returning to their initial position 22.

From the above descriptions it will therefore be understood that this invention now provides a slab-like insole or inner sole shoe device which will cushion heel impact and de-rotate the tibiofibular leg unit externally to create a more mechanically efficient gait which supinates the foot slightly during at least the first 20 to 25% of the gait cycle. The slab fits flat on the inner sole of the shoe and detorques the inward pronation of the tibiofibular leg unit, provides for more efficient propulsion and minimizes overuse syndromes caused by pronation in the normal walking, running or jogging gait.

It will also be understood that while the device is preferably in the form of an inner sole slab it could be constructed as an outer shoe sole with the ribs engaging the ground instead of the inside of a shoe.

I claim as my invention:

1. A detorquing heel control device for footwear which comprises a relatively rigid but resilient sole for footwear having a sole member shaped to extend from the rear of the heel to the metatarsal headrest area of footwear and having a smooth top surface inclined from a thin front edge to a transverse varus heel ridge followed by a heel cup and inclined upwardly from the lateral to the medial side and extending at the high level around the medial side of the heel cup, said member having a flat solid lateral bottom surface at the initial heel impact zone and extending forwardly therefrom with ribs radiating medially in an arc from the flat solid lateral bottom separated by grooves and widening along their lengths to terminal ends at the medial side thereof, and said ribs being positioned to successively flatten and shift forwardly as they are loaded to rotate the member laterally for decreasing pronation of the foot during the normal gait of a wearer of the footwear.

2. A footwear device for decreasing inward rotation of the leg during the gait of a wearer of the footwear which comprises a shoe sole having a flat solid lateral load bearing side with deformable ribs radiating spokewise therefrom in a clockwise direction around the heel end to the medial side, and said ribs flattening as foot load is applied thereto to progressively rotate for turning the sole laterally during the gait of the wearer.

3. A detorquing insole for footwear which comprises a molded plastic relatively hard elastomer slab shaped to fit the inner sole of a shoe across the width thereof and extending from the rear of the shoe heel into spaced relation from the toe of the shoe, said slab increasing in thickness from a thin front edge to an elevated rear end and having a top smooth surface with a heel cup at the rear end and a varus incline across the width thereof diverging from the lateral to the medial sides thereof, said slab having a flat solid bottom across the entire width thereof forwardly of the heel cup and a narrow flat solid bottom along the lateral side thereof positioned to support initial heel contact during the gait of a wearer, and deformable spaced ribs radiating from the narrow flat solid bottom portion around the heel to the medial side of the slab, said ribs being separated by grooves of uniform width and increasing in width from their lateral to their medial ends, and the direction of said ribs cooperating with the increasing widths of the ribs as they radiate from the flat solid lateral side of the slab being such as to develop a lateral rotation of the slab as load is progressively applied from the heel to the forward end of the slab.

4. A detorquing device for decreasing inward leg rotation during the normal gait of a wearer of the device which comprises an insole of relatively rigid but resilient molded plastics material having a smooth top foot receiving surface, a flat solid bottom surface decreasing in width from the front to the rear end along the lateral side of the insole and ribs radiating clockwise from the decreased width bottom portion to the medial side of the insole effective to shift the insole laterally as foot load is applied thereto during the normal gait of a user.

5. The device of claim 1 wherein the sole is a molded plastic slab sized for fitting in footwear and having a Shore hardness of from about 30 to about 80.

6. The device of claim 1 wherein the sole is sized to fit across the entire width of the inside of a shoe on the inner sole thereof and is inclined from the thin front edge to the heel end thereof.

7. The device of claim 1 wherein the grooves separating the ribs are of uniform width along their length.

8. The device of claim 2 wherein the flat solid lateral load bearing side extend from the lateral edge to an arc from which the ribs radiate.

9. The device of claim 2 wherein the solid load bearing side extends across the full width of the front end, narrows in width to the heel end and has the ribs radiating therefrom.

10. The device of claim 2 wherein the shoe sole is a plastics material slab fitting the inner sole of a shoe.

11. The device of claim 2 including a pair of mirror image shoe soles respectively fitting right and left shoes.

12. The device of claim 2 where the sole is an elastomer with a Shore hardness of between 45 to 65.

13. The insole of claim 3 wherein the slab tapers to a thin feather edge at the front end thereof.

14. The insole of claim 13 wherein the thin feather edge is convex.

15. The insole of claim 2 wherein the narrow flat solid bottom portion has an arcuate rear end and a flat diagonally sloping forward end.

16. The insole of claim 3 wherein the ribs radiate as spokes around an arcuate edge of the narrow flat solid bottom along the lateral side of the slab.

17. The detorquing device of claim 4 wherein the decreased width flat solid bottom portion along the lateral side of the insole has an arcuate edge from which the ribs radiate.

18. The detorquing device of claim 4 wherein the insole increases in thickness from the front to the rear end and has a heel cup depression in the rear end.

19. The device of claim 4 wherein the decreased width flat solid bottom surface along the lateral side has a circular medial edge.

* * * * *

UNITED STATES PATENT AND TRADEMARK OFFICE

CERTIFICATE OF CORRECTION

PATENT NO. : 4,268,980

DATED : May 26, 1981

INVENTOR(S) : Charles John Gudas

It is certified that error appears in the above—identified patent and that said Letters Patent is hereby corrected as shown below:

In the "Abstract", line 1, cancel "slab" and insert --device--.

In the Abstract, line 13, after "clockwise" insert --(right foot) or counterclockwise (left foot)--

Column 1, line 11, cancel "heat" and insert --heel--.

Column 1, line 28, cancel "dorsiflexing" and insert --plantar-flexing--.

Column 1, line 50, before "slab" insert --device or--.

Column 1, line 55, cancel "45 to 65" and insert --35 to 70--.

Column 1, line 67, cancel "3.2" and insert --2.5°-3.5°--.

Column 2, line 6, after "clockwise" insert --(right foot)--.

Column 2, line 31, after "clockwise" insert --(right foot)--.

UNITED STATES PATENT AND TRADEMARK OFFICE

CERTIFICATE OF CORRECTION

PATENT NO. : 4,268,980

DATED : May 26,1981

INVENTOR(S) : Charles John Gudas

It is certified that error appears in the above—identified patent and that said Letters Patent is hereby corrected as shown below:

Column 5, line 25, cancel "3.2" and insert --2.5°-3.5°--.

Column 6, line 40, cancel "shoe" and insert --foot--.

Column 6, line 41, cancel "countered" and insert --replaced--.

Column 6, line 42, cancel "shoe" and insert --foot--.

Column 9, line 6, cancel "45 to 65" and insert --35 to 70--.

Signed and Sealed this

*Twenty-third* Day of *February 1982*

[SEAL]

*Attest:*

GERALD J. MOSSINGHOFF

*Attesting Officer* *Commissioner of Patents and Trademarks*